US008670695B2

(12) United States Patent
Aoki et al.

(10) Patent No.: US 8,670,695 B2
(45) Date of Patent: Mar. 11, 2014

(54) IMAGE FORMING APPARATUS

(75) Inventors: Daisuke Aoki, Yokohama (JP); Tomoya Tateishi, Kamakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/358,908

(22) Filed: Jan. 26, 2012

(65) Prior Publication Data

US 2012/0121298 A1 May 17, 2012

Related U.S. Application Data

(63) Continuation of application No. PCT/JP2011/068638, filed on Aug. 11, 2011.

(30) Foreign Application Priority Data

Aug. 17, 2010 (JP) ..... 2010-182587

(51) Int. Cl.
*G03G 15/06* (2006.01)

(52) U.S. Cl.
USPC ..... 399/227; 464/169

(58) Field of Classification Search
USPC ..... 399/227; 464/20, 169
See application file for complete search history.

(56) References Cited

U.S. PATENT DOCUMENTS

| | | | | |
|---|---|---|---|---|
| 7,664,436 | B2 | 2/2010 | Aoki et al. | |
| 7,933,538 | B2 | 4/2011 | Aoki et al. | |
| 8,027,618 | B2 | 9/2011 | Aoki et al. | |
| 2007/0212112 | A1* | 9/2007 | Kadota et al. | 399/227 |
| 2010/0054814 | A1 | 3/2010 | Sakurai et al. | |
| 2011/0008072 | A1* | 1/2011 | Suzuki et al. | 399/227 |

FOREIGN PATENT DOCUMENTS

| | | | |
|---|---|---|---|
| CN | 101308344 | A | 11/2008 |
| JP | 11-223970 | A | 8/1999 |
| JP | 2005-3754 | A | 1/2005 |
| JP | 2008-310302 | A | 12/2008 |

OTHER PUBLICATIONS

Notification of the First Office Action dated Apr. 1, 2013, in Chinese Application No. 20118000425.5.
Form PCT/ISA/220 mailed Sep. 20, 2011 forwarding Form PCT/ISA/210 and Form PCT/ISA/237 in PCT/JP2011/068638.

* cited by examiner

*Primary Examiner* — David Gray
*Assistant Examiner* — Michael Harrison
(74) *Attorney, Agent, or Firm* — Fitzpatrick, Cella, Harper & Scinto

(57) ABSTRACT

An image forming apparatus includes an image bearing member on which an electrostatic image is to be formed; a rotatable supporting member, configured to support a developing device for developing the electrostatic image and configured to rotationally move the developing device toward a developing position, provided movably in a rotational axis direction with respect to a main assembly of the image forming apparatus; an urging member for urging the rotatable supporting member in the rotational axis direction. In addition, a regulating portion regulates a position of the rotatable supporting member, with respect to the rotational axis direction, urged by the urging member. The rotatable supporting member includes a first rotatable member provided movably in the rotational axis direction at one end side of the rotatable supporting member with respect to the rotational axis direction, and a second rotatable member provided movably in the rotational axis direction at the other end side of the rotatable supporting member. The urging member urges the first rotatable member and the second rotatable member apart.

8 Claims, 7 Drawing Sheets

IMAGE FORMING APPARATUS

This application is a continuation of International Patent Application No. PCT/JP2011/068638, filed Aug. 11, 2011.

TECHNICAL FIELD

The present invention relates to an image forming apparatus using a rotatable supporting member (rotary) which supports a plurality of developing devices.

BACKGROUND ART

A color electrophotographic image forming apparatus using a rotatable supporting member (rotary) which supports a plurality of developing devices has been conventionally known. In the image forming apparatus, by rotating the rotatable supporting member, any of the plurality of developing devices supported by the rotatable supporting member is successively moved to a developing position where the rotatable supporting member opposes a photosensitive drum. The developing device moved to the developing position is engaged with an electric energy supplying means and a drive transmitting means which are provided in an apparatus main assembly (of the image forming apparatus), so that electric energy supply and driving force transmission are effected (e.g., Japanese Laid-Open Patent Application 2008-310302). Then, by the developing device moved to the developing position, development of an electrostatic latent image formed on the photosensitive drum is effected.

In general, in a constitution using the above-described rotatable supporting member, from the viewpoint of operational stability, a gap with respect to a thrust direction is provided between the rotatable supporting member and the apparatus main assembly which supports the rotatable supporting member. The reason therefor is that when there is no sufficient gap in the case where a dimension with respect to the thrust direction is increased due to component tolerance or thermal expansion, the rotatable supporting member strongly urges against and interferes with the apparatus main assembly and thus there is a possibility that the rotatable supporting member constitutes a hindrance to rotation thereof. Further, in a constitution of the electric energy supply and drive transmission to the developing device, there is a need to constitute the rotatable supporting member with a width with respect to the thrust direction including the above-described gap.

However, in recent years, downsizing of the color electrophotographic image forming apparatus is advanced and with the downsizing of the apparatus, a size of the apparatus with respect to the thrust direction is also decreased, so that when the sufficient gap as described above is ensured, there is a problem that the downsizing of the apparatus is not readily realized.

DISCLOSURE OF THE INVENTION

In an embodiment of the present invention, there is provided an image forming apparatus comprising: an image bearing member on which an electrostatic image is to be formed; a rotatable supporting member, configured to support a developing device for developing the electrostatic image and configured to rotationally move the developing device toward a developing position, provided movably in a rotational axis direction with respect to a main assembly of the image forming apparatus; an urging member for urging the rotatable supporting member in the rotational axis direction; and a regulating portion for regulating a position of the rotatable supporting member, with respect to the rotational axis direction, urged by the urging member.

BEST MODE FOR CARRYING OUT THE INVENTION

Hereinbelow, with reference to the drawings, preferred embodiments of the present invention will be exemplary described in detail. However, dimensions, materials, shapes and relative configurations of constituent elements described in the following embodiments should be appropriately changed depending on constitutions and various conditions of apparatuses to which the present invention is applied. Therefore, unless otherwise noted specifically, the scope of the present invention is not limited to those in the following embodiments.

[First Embodiment]

[Color Electrophotographic Image Forming Apparatus]

Figure 1:
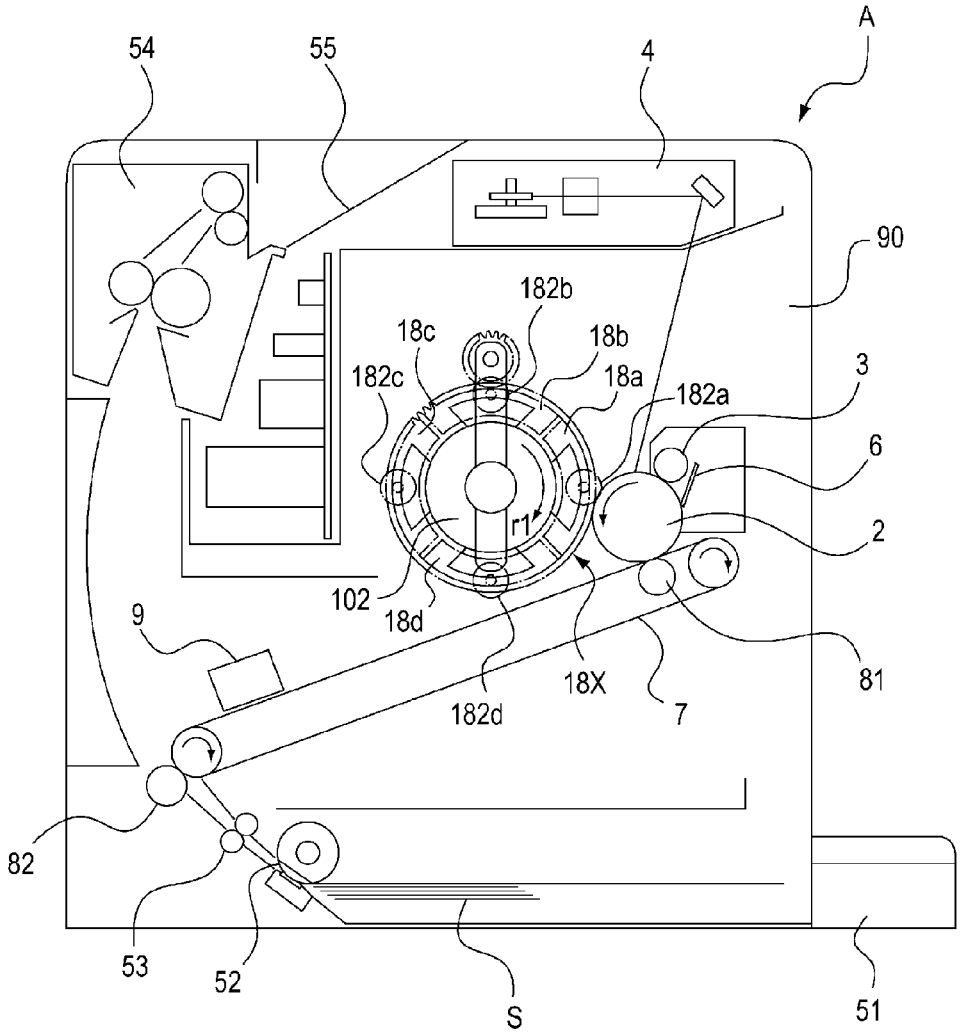
FIG. 1 is a schematic view showing a schematic structure of a color electrophotographic image forming apparatus including a rotary detachably supporting four developing devices.

A color electrophotographic image forming apparatus according to First Embodiment will be described. Herein, as the color electrophotographic image forming apparatus including a plurality of developing devices, a color laser beam printer including four developing devices is illustrated. FIG. 1 is a schematic view of the color laser beam printer.

First, a schematic structure and image forming operation of this color laser beam printer will be described.

As shown in FIG. 1, an image forming apparatus A includes a drum-shaped electrophotographic photosensitive member (image bearing member) (hereinafter referred to as a photosensitive drum) 2. Around the photosensitive drum 2, a charging roller 3, an exposure device 4, four developing devices 18*a*-18*d*, and a cleaning device 6 are disposed. The charging roller 3 is a charging means for electrically charging the photosensitive drum 2 uniformly. The exposure device 4 is an exposure means for irradiating the photosensitive drum 2 with laser light depending on image information. By irradiating the charged photosensitive drum 2 with the laser light, an electrostatic latent image (electrostatic image) is formed on the photosensitive drum 2. The developing devices 18*a* to 18*d* are a developing means for developing the latent image with a developer of a corresponding color to visualize the latent image. The cleaning device 6 is a cleaning means for removing the developer remaining on the support of the photosensitive drum 2.

The developing device 18*a* accommodates a yellow developer and is a yellow developing device for developing the electrostatic latent image with the yellow developer. The developing device 18*b* accommodates a magenta developer and is a magenta developing device for developing the electrostatic latent image with the magenta developer. The developing device 18*c* accommodates a cyan developer and is a cyan developing device for developing the electrostatic latent image with the cyan developer. The developing device 18*d* accommodates a black developer and is a black developing device for developing the electrostatic latent image with the black developer. That is, the developing devices 18*a*-18*d* develop the electrostatic latent image is formed on the photosensitive drum 2. The four developing devices 18*a*-18*d* are detachably supported by a rotary 102 which is a rotatable supporting member. Incidentally, although described later, the rotary 102 is rotatably supported by an apparatus main assembly 90 of the image forming apparatus A.

First, the photosensitive drum 2 is rotated in an arrow direction (counterclockwise direction) in FIG. 1 in synchronism with rotation of an intermediary transfer belt (intermediary transfer member) 7. Then, the support of this photosensitive drum 2 is uniformly charged by the charging roller 3. Further, with this charging, light irradiation for a yellow image is effected by the exposure device 4, so that the electrostatic latent image for yellow is formed on the photosensitive drum 2.

Simultaneously with this electrostatic latent image formation, the rotary 102 which is the rotatable supporting member is rotated by an unshown drive transmitting mechanism to be stopped after the yellow developing device 18*a* is rotationally moved toward a developing position 18X where the developing device 18*a* opposes the photosensitive drum 2. At the developing position 18X, a developing roller 182*a* provided to the developing device 18*a* contacts the photosensitive drum 2. Then, a voltage of the same polarity as a charge polarity of the photosensitive drum 2 and of the substantially same potential as that of the photosensitive drum 2 is applied to the developing roller 182*a* so that the yellow developer is deposited on the electrostatic latent image on the photosensitive drum 2. By this, the electrostatic latent image is developed with the yellow developer. That is, the rotary 102 successively moves the plurality of developing devices 18*a*-18*d* supported thereby one by one to the developing position 18X, where it opposes the photosensitive drum, by supporting the plurality of developing devices 18*a*-18*d* and rotating the developing devices 18*a*-18*d* in an arrow r1 direction. The developing device located at the developing position 18X develops the electrostatic latent image formed on the photosensitive drum 2 depending on the color of the developer accommodated therein.

Here, in this embodiment, as developing rollers 182*a*-182*d* of the respective developing devices, an elastic roller prepared by coating a rubber around a metal-made shaft is used. Incidentally, in this embodiment, at the developing position 18X, each of the developing rollers 182*a*-182*d* contacts the photosensitive drum 2 (contact developing type). Each of the developing rollers 182*a*-182*d* effects the development of the electrostatic latent image in a state in which it contacts the photosensitive drum 2. However, each developing device is not limited to this constitution. Each developing device is also applicable to such a constitution that the development of the latent image is effected in a state in which the photosensitive drum 2 does not contact any of the developing rollers 182*a*-182*d* at the developing position 18X but is near to the developing device at the developing position 18X. Even in such a constitution, an effect described later can be obtained.

After the electrostatic latent image is developed as described above, a voltage of an opposite polarity to the charge polarity of the developer is applied to a primary transfer roller 81 disposed inside the intermediary transfer belt 7. By this, the yellow developer image formed on the photosensitive drum 2 is primary-transferred onto the intermediary transfer belt 7.

As described above, the primary transfer of the yellow developer image is ended. Then, the developing devices 18*b*-18*d* of colors of magenta, cyan and black, respectively, are successively moved rotationally by the rotation of the rotary 102 and stop at the developing position 18X where the rotary 102 opposes the photosensitive drum 2. Then, similarly as in the case of yellow, with respect to the respective colors of magenta, cyan and black, formation, development and primary transfer of the electrostatic latent images are successively effected. By this, the four color developer images are superposed on the intermediary transfer belt 7.

During this, a secondary transfer roller 82 does not contact the intermediary transfer belt 7. Further, at this time, also a cleaning unit 9 for removing residual toner on the photosensitive drum 2 does not contact the intermediary transfer belt 7.

On the other hand, a sheet S as a recording medium (material) is accommodated in a cassette 51 provided at a lower portion of the apparatus main assembly 90. Incidentally, the recording medium is a member on which the developer images are to be formed and is, e.g., recording paper, an OHP sheet or the like. The sheet S is separated and fed one by one from the cassette 51 by a feeding roller 52 and then is fed to a registration roller pair (conveying rollers) 53. The registration roller pair 53 sends the fed sheet S between the intermediary transfer belt 7 and the secondary transfer roller 82. Here, the secondary transfer roller 82 and the intermediary transfer belt 7 are in a press-contact state (state shown in FIG. 1).

Further, a voltage of the opposite polarity to the charge polarity of the developer is applied to the secondary transfer roller 82, so that the four color developer images superposed on the intermediary transfer belt 7 are collectively transferred (secondary-transferred) onto the support of the sheet S.

The sheet S on which the developer images are transferred is sent to a fixing device (fixing means) 53. In the fixing device 54, the sheet S is heated and pressed, so that the developer images are fixed on the sheet S. By this, a color image is formed on the sheet S. Then, this sheet S is discharged from the fixing device 54 to a discharge portion of an upper cover 55 at an outside portion of the apparatus main assembly 90.

[Constitution Around Rotary]

Figure 2:
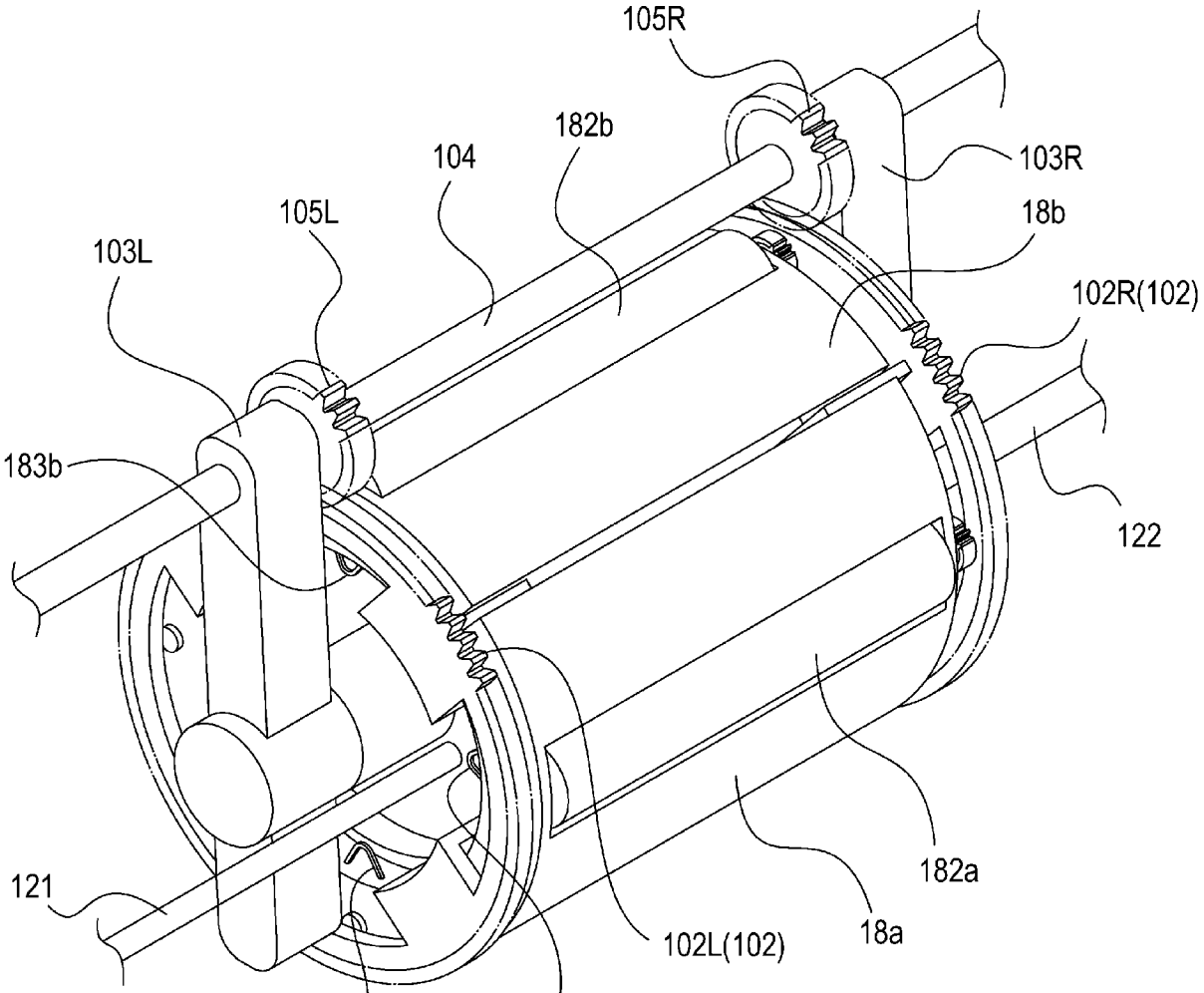
FIG. 2 is a perspective view of a rotary structure according to a First Embodiment.
Figure 6:
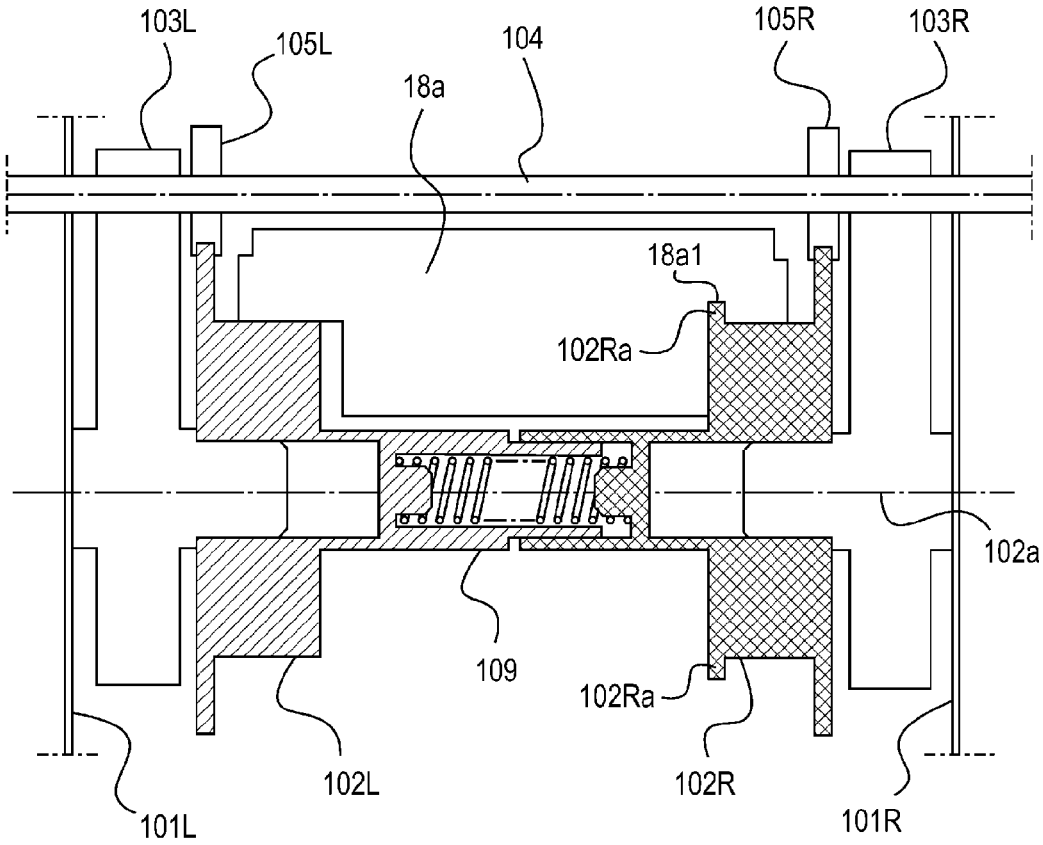
FIG. 6 is a schematic view of the rotary structure in which the developing device according to First Embodiment is mounted.

Here, by using FIG. 2, FIG. 3 and FIG. 6, a constitution around the rotary 102 will be described. FIG. 2 is a perspective view showing a principal portion in the neighborhood of the rotary 102, FIG. 3 is a schematic view of the principal portion in the neighborhood of the rotary 102 in which the developing device 18*a*-18*d* in FIG. 2 are not illustrated, and FIG. 6 is a schematic view showing a state in which a single developing device is mounted.

Figure 3:
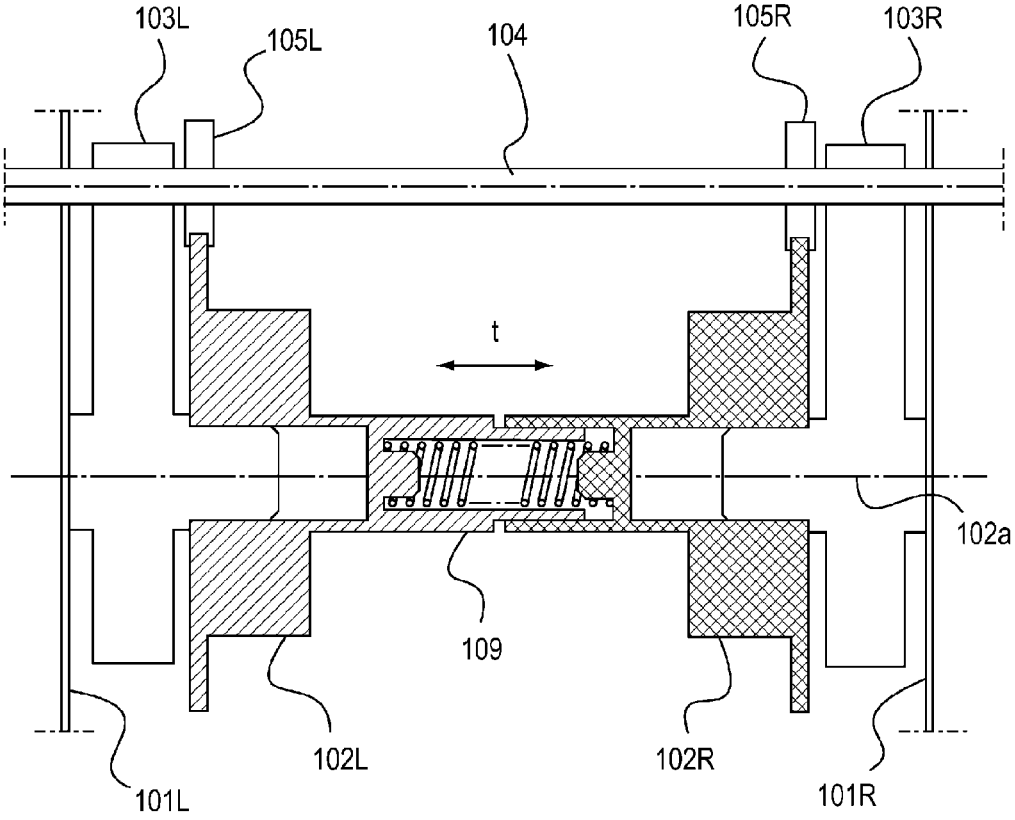
FIG. 3 is a schematic view of the rotary structure according to the First Embodiment.

As shown in FIG. 2 and FIG. 3, the rotary 102 which is the rotatable supporting member is constituted movably in a thrust direction by a plurality of rotatable members and is herein constituted by a left disk (first rotatable member) 102L and a right disk (second rotatable member) 102R which are two rotatable members. The left disk 102L and the right disk 102R are movably engaged with each other in the thrust direction (direction of a rotation shaft 102*a* of the rotary (arrow t direction in FIG. 3)). Specifically, the left disk 102L is provided movably in the direction of the rotation shaft 102*a* at one end side of the rotary 102 with respect to the direction of the rotation shaft 102*a* of the rotary 102. The right disk 102R is provided movably in the direction of the rotation shaft

102*a* at the other end side of the rotary 102 with respect to the direction of the rotation shaft 102*a* of the rotary 102.

By a driving shaft 102 rotatably supported by the apparatus main assembly 90, a left arm (first supporting member) 103L and a right arm (second supporting member) 103R are rotatably supported. The left arm 103L rotatably supports the left disk 102L and swingably supports the left disk 102L with respect to the apparatus main assembly 90, and is provided movably in the direction of the rotation shaft 102*a*. The right arm 103R rotatably supports the right disk 102R and swingably supports the right disk 102R with respect to the apparatus main assembly 90, and is provided movably in the direction of the rotation shaft 102*a*.

Further, the left disk 102L is regulated with respect to the thrust direction by the left arm 103L and the right disk 102R is regulated with respect to the thrust direction by the right arm 103R. Further, the left arm 103L rotatably supporting the left disk 102L and the right arm 103 rotatably supporting the right disk 102R are supported movably in the thrust direction (axial direction) by the driving shaft 104.

On the other hand, to the driving shaft 104, a left driving gear 105L and a right driving gear 105R which rotate integrally with the driving shaft 104 are mounted. This left driving gear 105L engages with the left disk 102L and the right driving gear 105R engages with the right disk 102R. Therefore, when a driving force of an unshown driving source (e.g., a pulse motor) provided to the apparatus main assembly is transmitted to the driving shaft 104, the left driving gear 105L and the right driving gear 105R are rotated integrally with the driving shaft 104. Then, the left disk 102L engaging with the left driving gear 105L and the right disk 102R engaging with the right driving gear 105R are rotated in synchronism with each other, so that the rotary 102 is rotated.

Further, between the left disk 102L and the right disk 102R which constitute the rotary 102, a compression spring 109 as an urging means (urging member) is provided. This compression spring 109 generates a force for urging the left disk 102L toward a left frame (first regulating portion) 101L side provided in the apparatus main assembly and for urging the right disk 102R toward a right frame (second regulating portion) 101R side provided in the apparatus main assembly. That is, the compression spring 109 urges the left disk 102L and the right disk 102R toward one side and the other side (opposite direction), respectively, with respect to the thrust direction. By this urging, as shown in FIG. 3, the left disk 102L and the left arm 103L are contacted toward the left frame 101L side with no gap, so that the position thereof with respect to the rotational axis direction is regulated. Further, by this urging, the right disk 102R and the right arm 103R are contacted toward the right frame 101R side with no gap, so that the position thereof with respect to the rotational axis direction is regulated.

By such a constitution, with respect to the rotational axis direction, a need to provide a large gap, in anticipation of tolerance and thermal expansion, between the developing rotary and the apparatus main assembly in advance is eliminated, so that it becomes possible to realize the downsizing of the image forming apparatus with respect to the rotational axis direction.

Incidentally, the developing devices 18*a*-18*d* mounted in the rotary 102 are regulated in position with respect to the rotational axis direction by the constitution as shown in FIG. 6. In FIG. 6, a positioning portion 102 Ra in a projection shape is provided to the right disk 102R and by engagement of a portion to be positioned 18*a*1 in a recess shape of the developing device with this positioning portion 102Ra, the position of the developing device relative to the right disk with respect to the rotational axis direction is regulated. Then, this right disk 102R is urged toward the right frame 102R side by the compression spring (urging member) 109, whereby the position of the right disk 102R relative to the apparatus main assembly with respect to the rotational axis direction is determined. Further, by this, the position of the developing device 18*a* relative to the apparatus main assembly with respect to the rotational axis direction is determined.

[Electric Energy Supply and Drive Transmission Constitution to Developing Device]

Figure 4:
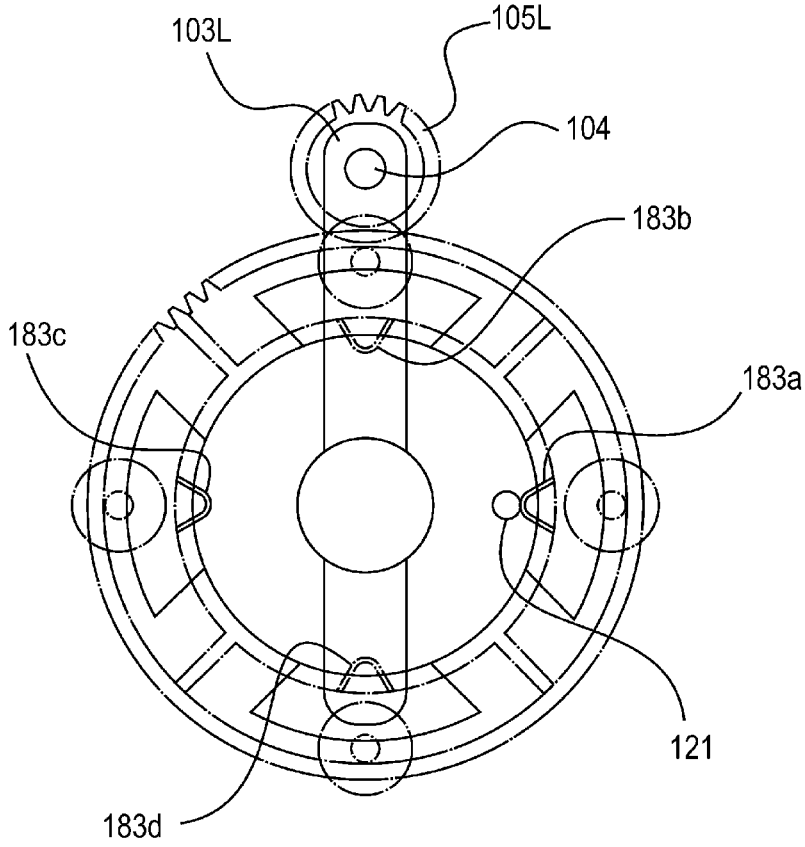
FIG. 4 is a left side view of the rotary structure according to the First Embodiment.
Figure 5:
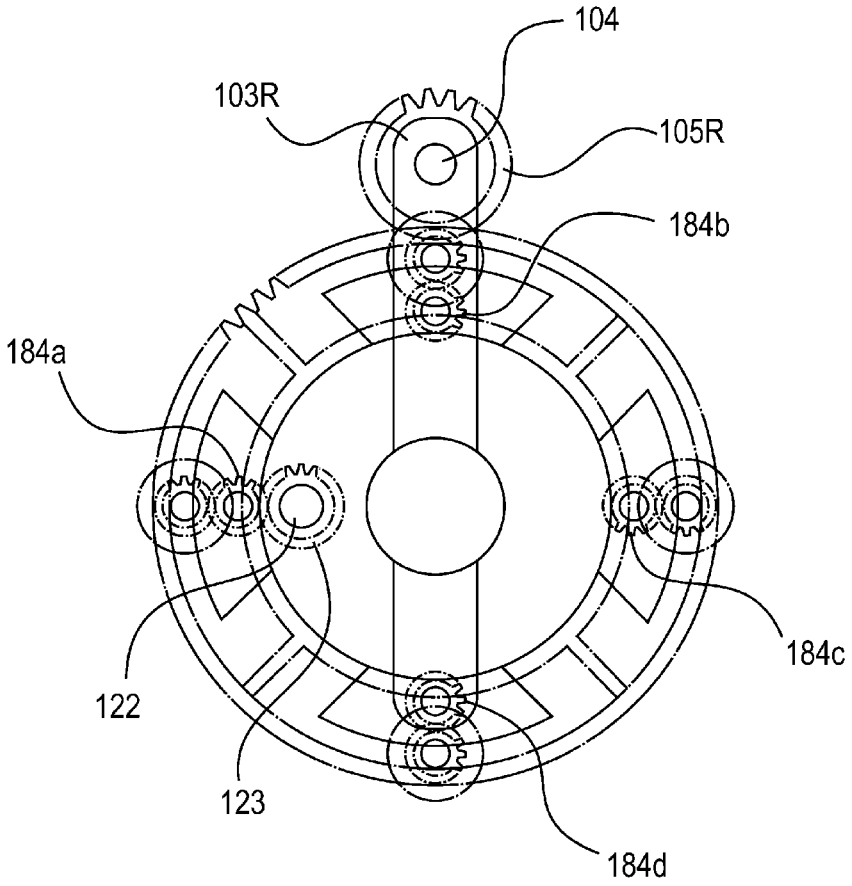
FIG. 5 is a right side view of the rotary structure according to the First Embodiment.

Here, by using FIG. 4 and FIG. 5, the electric energy supply and drive transmission constitution to the developing devices will be described. FIG. 4 is a left side view around the rotary 102 of FIG. 3. FIG. 5 is a right side view around the rotary 102 of FIG. 3.

As shown in FIG. 4, the developing devices 18*a*-18*d* are provided with contacts 183*a*-183*d*, respectively, as an electric energy receiving portion. Each of the contacts 183*a*-183*d* press-contact (contact), at the developing position 18X, an electric energy supplying rod 121 as an electric energy supplying portion provided in the apparatus main assembly 90, thus being supplied with the electric energy. Here, as the contacts 183*a*-183*d*, a wire with a spring property is used but the contacts are not limited to this wire. The electric energy supplying rod 121 is provided at one end side with respect to the above-described rotation axis 102*a* direction in the apparatus main assembly 90.

On the other hand, as shown in FIG. 5, the developing devices 18*a*-18*d* are provided with input gears 184*a*-184*d*, respectively, as a drive receiving portion. Each of the developing devices 18*a*-18*d* engages (connects), at the developing position 18X, with a driving transmitting gear 123 as a drive transmitting portion which rotates integrally with a drive transmitting shaft 122 rotatably supported by the apparatus main assembly 90. At the developing position 18X, when the driving force is transmitted from the engaged drive transmitting gear 123 to the input gears 184*a*-184*d*, each of the developing rollers 182*a*-182*d* is rotated. The drive transmitting gear 123 as the drive transmitting portion is provided at the other end side with respect to the rotational axis direction 102*a* in the apparatus main assembly 90.

Therefore, when the rotary 102 is rotated to move any of the developing devices 18*a*-18*d* to the developing position 18X, the developing device moved to the developing position 18X receives the electric energy from the apparatus main assembly 90 and also receives the driving force from the apparatus main assembly 90, thus being capable of developing the latent image formed on the photosensitive drum 2.

In an ordinary rotary constitution, from the viewpoint of the operational stability, the gap was provided with respect to the thrust direction and therefore there was a need to constitute the rotary with a thrust width including the gap in the electric energy supply and drive transmission (constitution) to the developing devices. However, as described above, in this constitution, the left disk 102L and the right disk 102R abut toward the left frame 101L and the right frame 101R via the left warm 103L and the right arm 103R, respectively. That is, a constitution in which the gap with respect to the thrust direction is eliminated is employed. For that reason, the electric energy supplying and drive transmitting structure can be disposed without taking into consideration the gap between the rotary 102 and the apparatus main assembly 90, so that a thrust length of the apparatus main assembly can be made small. That is, even when the size of the apparatus main assembly 90 is decreased with the downsizing of the image forming apparatus A, it is possible to effect the electric energy supply and drive transmission to the developing devices 18*a*-

18*d* with space saving and with high accuracy, so that it becomes possible to effect the electric energy supply and drive transmission to the developing devices with high reliability.

[Second Embodiment]

Figure 7:
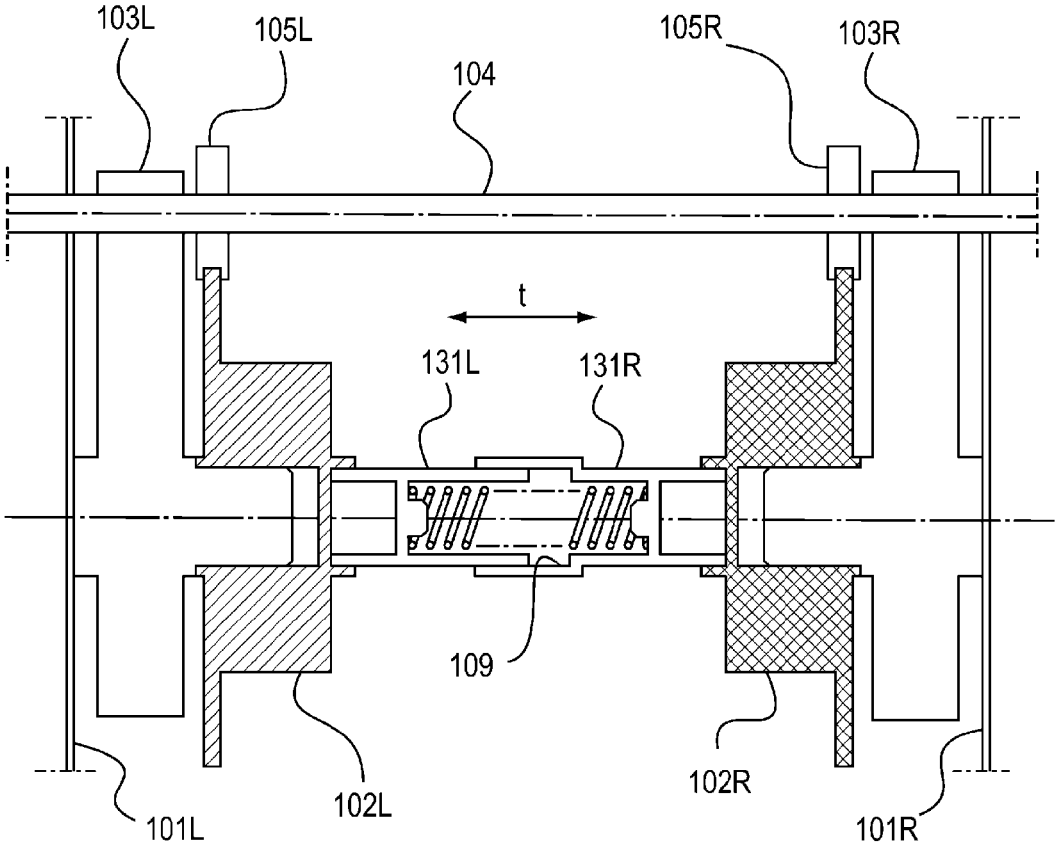
FIG. 7 is a schematic view of a rotary structure according to a Second Embodiment.

A color laser beam printer according to Second Embodiment will be described. FIG. 7 is a schematic view of a color laser beam printer according to Second Embodiment from which a rotary portion is extracted and is the view to be compared with FIG. 3 in First Embodiment. In this embodiment, compared with the above-described First Embodiment, a left rod (third rotatable member) 131L and a right rad (fourth rotatable member) 131R are added, so that a member which is constituted by the two rotatable members and is sandwiched between rotatable supporting member portions is provided.

The left rod 131L and the right rod 131R are sandwiched between the two disks, i.e., the left disk 102L and the right disk 102R which constitutes the rotary 102, and are a sandwich member movable to one side and the other side with respect to the thrust direction. The left rod 131L is detachably engaged with the left disk 102L, and the right rod 131R is detachably engaged with the right disk 102R. Further, the left rod 131L and the right rod 131R are movably engaged with each other in the thrust direction (arrow t direction in FIG. 7).

Between the left rod 131L and the right rod 131R as this sandwich member, the compression spring 109 as the urging means is provided. An urging force of the compression spring 109 transmits through the left rod 131L to urge the left disk 102L toward the left frame 101L side which is the one side with respect to the thrust direction. Further, the urging force of the compression spring 109 transmits through the right rod 131R to urge the right disk 102R toward the right frame 101R side which is the other side with respect to the thrust direction. That is, the compression spring 109 urges the left disk 102L and the right disk 102R toward the one side and the other side (opposite direction) with respect to the thrust direction via the left rod 131L and the right rod 131R, respectively. By this, similarly as in the above-described embodiment, the left disk 102L and the left arm 103L are in a state in which they are abutted against the left frame 101L side with no gap, and the right disk 102R and the right arm 103R are in a state in which they are abutted against the right frame 101R side with no gap.

An effect of eliminating the gap between the rotary 102 and the apparatus main assembly 90 is the same as that in the above-described First Embodiment but by providing the left rod 131L and the right rod 131R which are separate members, this embodiment is advantageous in the case where the rotary 102 is subjected to impact or in terms of an assembling property.

In the case of the above-described First Embodiment, when the left frame 101L and the right frame 101R are assembled, at the same time, the left disk 102L and the right disk 102R are required to be assembled. If the left disk 102L and the right disk 102R are assembled after the left frame 101L and the right frame 101R are assembled, the left disk 102L and the right disk 102R are required to be stroked toward the inside in order to be assembled with the left arm 103L and the right arm 103R. In this case, when the left disk 102L or the right disk 102R is subjected to strong impact with respect to the thrust direction, the left disk 102L or the right disk 102R is moved in the thrust direction, so that there is a possibility that the engagement with the left driving gear 105L or the right driving gear 105R is disengaged. When the engagement with these gears is once discharged, it is difficult to ensure restoration to the original state.

That is, by providing the left rod 131L and the right rod 131R, compared with First Embodiment, latitude in assembly can be increased, so that flexibility in impact with respect to the thrust direction is increased.

[Other Embodiments]

In the above-described First Embodiment, the constitution including the electric energy supplying portion (electric energy supplying rod 121) at the one side of the apparatus main assembly 90 with respect to the thrust direction and the drive transmitting portion (drive transmitting gear 123) at the other side of the apparatus main assembly with respect to the thrust direction is described as an example but the present invention is not limited thereto. For example, a constitution in which the electric energy supplying portion and the drive transmitting portion are provided at either one of the one side and the other side with respect to the thrust direction. In this case, the rotatable supporting member (rotary 102) may only be required to be urged toward the side where the electric energy supplying portion and the drive transmitting portion are provided. At that time, the compression spring (urging means) 109 may be provided between the left disk 102L and the right disk 102R which constitute the rotary 102 but a similar effect is obtained also by providing the urging means between, e.g., the right disk 102R and the right arm 103R. At that time, the rotary 102 (the left disk 102L and the right disk 102R) is not required to be the separate member and may also be integrally constituted.

Further, in the above-described embodiments, the four developing devices detachably mountable to the rotatable supporting member are used but the number of use of the developing devices is not limited and may be appropriately set as desired.

Further, in the above-described embodiments, the printer is exemplified as the image forming apparatus but the present invention is not limited thereto. For example, the image forming apparatus may also be another image forming apparatus such as a copying machine or a facsimile apparatus, or another image forming apparatus such as a multi-function machine with a combination of functions of the these machines. Alternatively, the image forming apparatus may also be an image forming apparatus in which a recording medium carrying member is used and respective color toner images are successively transferred superposedly onto the recording medium carried on the recording medium carrying member. By applying the present invention to the image forming apparatus including the rotatable supporting member for detachably supporting the plurality of the developing devices, a similar effect can be obtained.

[Industrial Applicability]

As described above, according to the present invention, an image forming apparatus capable of downsizing the image forming apparatus with respect to the thrust direction is provided.

The invention claimed is:

1. An image forming apparatus comprising:

an image bearing member on which an electrostatic image is to be formed;

a rotatable supporting member, configured to support a developing device for developing the electrostatic image and configured to rotationally move the developing device toward a developing position, provided movably in a rotational axis direction with respect to a main assembly of said image forming apparatus;

an urging member for urging said rotatable supporting member in the rotational axis direction; and a regulating portion for regulating a position of said rotatable supporting member, with respect to the rotational axis direction, urged by said urging member, said rotatable supporting member including a first rotatable member provided movably in the rotational axis direction at one end side of said rotatable supporting member with respect to the rotational axis direction, and a second rotatable member provided movably in the rotational axis direction at the other end side of said rotatable supporting member with respect to the rotational axis direction, wherein said urging member is provided between said first rotatable member and said second rotatable member and urges said first rotatable member and said second rotatable member apart.

2. An image forming apparatus according to claim 1, further comprising a third rotatable member, engaged with said first rotatable member provided movably in the rotational axis direction, and comprising a fourth rotatable member, engaged with said second rotatable member, provided movably in the rotational axis direction, wherein said urging member is provided between said third rotatable member and said fourth rotatable member and urges said third rotatable member and said fourth rotatable member apart.

3. An image forming apparatus according to claim 1, further comprising:

an electric energy supplying portion, provided at the one end side in the main assembly of said image forming apparatus and connected to an electric energy receiving portion provided to the developing device, for supplying electric energy to the developing device via the electric energy receiving portion;

a drive transmitting portion, provided at the other end side in the main assembly and connected to a drive receiving portion provided to the developing device, for transmitting drive to the developing device via the drive receiving portion; and a positioning portion, provided to said second rotatable member, for determining a position of the developing device with respect to the rotational axis direction.

4. An image forming apparatus according to claim 1, further comprising:

a first supporting member, provided movably in the rotational axis direction, for rotatably supporting said first rotatable member and for swingably supporting said first rotatable member with respect to the main assembly of said image forming apparatus; and a second supporting member, provided movably in the rotational axis direction, for rotatably supporting said second rotatable member and for swingably supporting said second rotatable member with respect to the main assembly, wherein said regulating portion includes a first preventing portion for preventing movement of said first supporting member in the rotational axis direction in contact with said first supporting member and includes a second preventing portion for preventing movement of said second supporting member in the rotational axis direction in contact with said second supporting member.

5. An image forming apparatus according to claim 1, wherein said rotatable supporting member supports a plurality of developing devices in order to form a color image.

6. An image forming apparatus according to claim 1, wherein said first rotatable member is provided at one end side of the developing device and said second rotatable member is provided at the other end side of the developing device.

7. An image forming apparatus according to claim 1, wherein each of said first rotatable member and said second rotatable member is a disk.

8. An image forming apparatus according to claim 2, wherein each of said third rotatable member and said fourth rotatable member is a rod.

* * * * *